US005152809A

United States Patent [19]

Mattesky

[11] Patent Number: 5,152,809

[45] Date of Patent: Oct. 6, 1992

[54] SCRUB PUFF

[75] Inventor: Henry Mattesky, Cedar Grove, N.J.

[73] Assignee: Herbert Glatt, Morristown, N.J.

[21] Appl. No.: 552,781

[22] Filed: Jul. 16, 1990

[51] Int. Cl.[5] ..... B24B 1/00

[52] U.S. Cl. ..... 51/295; 51/296; 51/298; 51/307; 51/308; 51/309

[58] Field of Search ..... 51/295, 296, 298, 307, 51/308, 309

[56] References Cited

U.S. PATENT DOCUMENTS

| | | | |
|---|---|---|---|
| 3,166,388 | 1/1965 | Riegger et al. | 51/296 |
| 3,906,684 | 9/1975 | Marshall et al. | 51/296 |
| 4,038,047 | 7/1977 | Haywood | 51/296 |
| 4,078,340 | 3/1978 | Klecker et al. | 51/296 |
| 4,255,164 | 3/1981 | Butzke et al. | 51/295 |
| 4,263,755 | 4/1981 | Globus | 51/295 |
| 4,331,453 | 5/1982 | Dau et al. | 51/296 |
| 4,576,612 | 3/1986 | Shulka et al. | 51/295 |
| 4,581,287 | 4/1986 | Smith et al. | 51/296 |
| 4,773,920 | 9/1988 | Chasman et al. | 51/295 |
| 4,922,675 | 5/1990 | Sato et al. | 51/295 |
| 4,927,432 | 5/1990 | Budinger | 51/296 |
| 4,949,511 | 8/1990 | Endo et al. | 51/295 |
| 4,991,362 | 2/1991 | Heyer et al. | 51/295 |

*Primary Examiner*—Mark L. Bell
*Assistant Examiner*—W. T. Thompson
*Attorney, Agent, or Firm*—Omri M. Behr

[57] ABSTRACT

An open low density abrasive article adapted for the cleaning of aluminum or similar surfaces comprising a lofty open non-woven three dimensional web form of a plurality of interlaced randomly extending flexible durable, tough, resilient organic fibers said web fibers being firmly adhesively bonded together at points where they cross and contact each other to form a three-dimensionally integrated structure throughout said web, and abrasive particles distributed within said web and firmly bonded to the web fibers by a relatively hard binder, the interstices between adjacent fibers being open and substantially unfilled by binder or abrasive, there being defined throughout said aricle a tridimensionally extending network of intercommunicating voids constituting the major portion of the volume of the said article, said article being flexible and readily compressible and, upon release of pressure capable of recovering substantially completely to its initial form, wherein said abrasive is defined by any one of the measures of hardness selected from the group of measures consisting of a) Mho's 4.5-6.3, b) Rockwell B60-85, c) Brinell 95-142, d) Knoopp 120-180. In certain embodiments, the abrasive layer may be associated with sponge-like material and/or a cleansing or lubricating agent suitably a soap.

43 Claims, 2 Drawing Sheets

SCRUB PUFF

FIELD OF THE INVENTION

Non-scratching abrasives for cleaning and polishing moderately soft metal surfaces such as, aluminum, copper, brass and bronze.

BACKGROUND OF THE INVENTION

This invention relates to a cleansing aid, including the process of fabricating same, adapted for home use in the cleansing of kitchen utensils and the like. More particularly, the invention relates to the structure of and process for making a cleansing aid in the form of a pad presenting highly effective and durable abrasive surfaces, and optionally having incorporated therewith a water-soluble cleansing agent, Further, said pad may optionally include means for retaining liquified cleansing agent within the pad to thereby prevent unnecessary wastage of the cleansing agent.

A cleansing or scouring pad of the type above referred to should ideally represent a combination of several functional and physical characteristics. It is, of course, desired that the outer surfaces of the pad provide a good abrasive action, be of an open or lofty structure so as not to mat or become clogged by the dirt, grease or other material removed in the cleansing operation and furthermore be of a rust-free material.

DISCUSSION OF THE PRIOR ART

For decades, the cleaning material of choice for metal surfaces of moderate softness has been steel wool of various grades, sold with or without soap. While pads of such material are excellent cleaners, they suffer from well known problems which heretofore have not been fully overcome. Unless stainless steel is used, the pads rust rapidly after initial use, they do not retain the soap well after the initial use and the steel fibers tend to break and embed themselves into the skin of the hand of the user.

It is desirable that the pad of sufficient resilience so as to be comfortable to handle and also capable or conforming to irregular contours in the article or utensil to be cleansed. The pad may be provided with its own self-contained supply of a A web of abrasive material of the sort above described has heretofore been described in U.S. Pat. No. 2,327,199, issued to Clarence Robert Loeffler, issued Aug. 17, 1943, and in the U.S. Pat. No. 2,334,572, to R. L. Melton, et al., issued Nov. 16, 1943.

The seminal improvement in this technology is set forth in U.S. Pat. No. 2,958,593 to Hoover et al., assigned to 3M Corporation. This disclosed a class of products sold by the assignee under their trade mark "Scotch Brite" and associated marks. These products, as well as developments thereof, such as Klecker et al. U.S. Pat. No. ,4,078,340 and Fitzer U.S. Pat. No. 4,227,350, have the disadvantage that while they clean well they cannot be effectively used on metallic cookware surfaces as they are too abrasive and cause unsightly scratches. They particularly scratch aluminum and copper cookware surfaces. Similarly they cannot be used on soft coatings such as those of PTFE (or Teflon, (Trademark of DuPont Corp., Wilmington, Del.)).

Improved cleaning aids of the interior pad type are disclosed in U.S. Pat. No. 3,284,963, issued Nov. 15, 1966, to Samuel Lanham, et. al. While the Lanham product constituted an advance over the art, both it and the Hoover device are not suitable for polishing metals particularly moderately soft metals. Thus while Lanham states that any suitable abrasive may be used he, in fact, only mentions aluminum oxide, silicon carbide and the like which clean metal surfaces, but also scratch them in an unacceptable manner.

It would therefore be desirable to provide abrasive pads having the desirable qualities of steel wool pads without the aforesaid disadvantages, which could be used for the cleaning and polishing of moderately soft metal surfaces, in particular those of copper, brass, bronze and especially aluminum.

SUMMARY

There is provided an open low density abrasive article adapted for the cleaning of all metallic surfaces and particularly moderately soft metallic surfaces, suitably non-ferrous surfaces such as copper, brass, bronze and, in particular, aluminum surfaces comprising in one embodiment a lofty open non-woven three dimensional web form of a plurality of interlaced randomly extending flexible durable, tough, resilient organic fibers having a diameter of from about 25 to about 250 microns.

These web fibers are firmly adhesively bonded together at points where they cross and contact each other to form a three-dimensionally integrated structure throughout said web, and abrasive particles generally evenly distributed on each fiber within said web and are firmly bonded to the web fibers by a relatively hard binder, the interstices between adjacent fibers being open and substantially unfilled by binder or abrasive. Thus, there is defined throughout said article a tridimensionally extending network of intercommunicating voids constituting the major portion of the volume of the said article.

The article is flexible and readily compressible and, upon release of pressure capable of recovering substantially completely to its initial form. In addition to the web substrate, there may be utilized foam substrate from foams selected from the group comprising urethane foams, polypropylene, polyethylene, polyvinyl alcohol, silicone rubber, neoprene, or natural rubber latex foams. Density ranges of these foams are typically between 0.015–0.1 g/cm$^3$.

Woven fabrics can also be used as carriers for the abrasive materials. All fabric constructions may be considered for specific applications, in particular is Terry Fabric of the surface density range from 100 g/m$^2$ to 410 g/m$^2$, and open or textured weave fabrics such as ducks, twills, oznabergs, and leno weaves. These materials may be woven of natural or synthetic fibers, but of particular advantage are cotton, polyester, or nylon. Typical surface density appropriate for this application are fabrics from 45 g/m$^2$ to 340 g/m$^2$. (i.e., weight/surface area).

A wide variety of engineered non-woven fabrics can be used to advantage as abrasive carriers, among them are those produced by spun bonded, fiber entangled, thermal and chemical bonded, spun-laced, print bonded, and needle punched. These materials may be made from natural or synthetic fibers or blends there of, non-wovens of rayon, polyester, or nylon can be used to particular advantage of a surface density of 75 g/m$^2$ to 285 g/m$^2$.

Papers of various kinds can be used as carriers for the abrasives described depending on specific applications. Naturally substrate normally used for sandpaper applications would be suitably of surface density of 100 $g/m^2$ to 1 $kg/m^2$.

An example of such paper would have the following specifications: A weight of 117 $g/m^2$, type-Kraft and/or treated with zinc chloride, thickness-0.075 cm. Other papers of high wet strength can also be used.

The abrasive is applied to non web materials, i.e., fabrics (woven and non-woven) by coating them with a suitable adhesive resin followed by spraying dry abrasive powder.

Provided it is not water soluble, the sole criterion for the abrasive is that it may be defined by any one of the measures of hardness selected from the group of measures consisting of a) Mho's 4.5-6.3, b) Rockwell B 60-85, c) Brinell 95-142, or d) Knoop 120-180. As long as the aforesaid hardness criteria are met, the actual chemical nature of the abrasive is unimportant. In certain embodiments, the abrasive layer may be associated with a lubricant which may, but need not be a soap and/or sponge-like material.

DESCRIPTION OF THE PREFERRED EMBODIMENTS

For use as abrasive web material for the abrasive coating, it has been found that synthetic fibers such as nylon and polyesters (e.g., Dacron) are particularly well suited. The uniformity and quality of such types of fibers can be closely controlled. Also, these fibers retain substantially their desired physical properties when wet with water or oil. However, various natural fibers which are flexible, resilient, durable, and tough can also be utilized in the web material. The resulting extremely open fibrous construction exhibits a remarkably effective action. It is essentially non-clogging and non-filling in nature, particularly when used in conjunction with liquids such as water and oils. Furthermore, it can be readily cleaned upon simple flushing with a rinsing liquid, dried and left for substantial periods of time and then reused with all its original properties intact. The structure of the web is flexible and readily compressible and upon release of compression returns substantially completely to the initial uncompressed form.

When a further cleansing or lubricating material retention layer is used either as a second lamina or third or inner lamina between two outer web lamina of the pad, it is preferably formed of a foamed synthetic, thermoplastic material, such as for example polyurethane form or the like which may be either of the polyester or polyether type. Due to the cellular structure of this foamed material, the inner web is highly flexible and compressible, thereby adding resilience to the overall pad, the cellular structure furthermore enabling the web to readily absorb the retain water which is not characteristic of the outer laminae of the pad. Thus, as the pad is wetted in preparation for use, the wetting of the water-soluble cleansing agent preferably incorporated therewith may liquify or emulsify a portion of the cleansing or lubricating agent, thus causing the solution to become absorbed in the pores and cellular structure of the foamed inner web material. Thereafter as the pad is put to use, the inner lamina of foam material is somewhat compressed causing the solution of cleansing or lubricating agent to be exuded from the foam material and applied to the surface of the article being cleansed. Upon reuse of the pad, after having dried, the introduction of water thereto first saturates the inner foamed web and thus places in solution the film of cleansing agent lining the pores and cells of the form material thereby minimizing the amount of additional cleansing agent required.

The second as well as the intermediate or inner lamina of the foam web material when used also serves as an effective means for binding the laminae or plies of the composite pad into a unified and integral structure.

In accordance with one embodiment of pad structure the bonding of the three laminae is achieved by application of both heat and pressure at only the border area of the pad so as to produce a fin-sealed edge or lip comprised of the three pad laminae bound together in a compressed state. In this embodiment the application of heat also acts as a resin binder on the two outer laminae so as to effect a binding of the fibers of said outer laminae in a compressed state.

According to another embodiment of the invention, the bonding of the three laminae is achieved through a flame lamination technique by which heat is applied to the entire surface on both sides of the inner web of foamed material, whereupon each outer ply is brought into contact with a respective heated surface with a force sufficient to effect a surface bond and furthermore enabling the web to readily absorb the retain water which is not characteristic of the outer laminae of the pad. Thus, as the pad is wetted in preparation for use, the wetting of the water-soluble cleansing agent preferably incorporated therewith liquifies a portion of the cleansing agent, thus causing the solution to become absorbed in the pores and cellular structure of the foamed inner web material. Thereafter as the pad is put to use, the inner lamina of foam material is somewhat compressed causing the solution of cleansing agent to be exuded from the foam material and applied to the surface of the article being cleansed. Upon reuse of the pad, after having dried, the introduction of water thereto first saturates the inner foamed web and thus places in solution the film of cleansing agent lining the pores and cells of the form material thereby minimizing the amount of additional cleansing agent required.

In the case of each embodiment, the bonding of the several laminae into an integral product is accomplished without the addition of any glue, adhesive or other binding additives which might tend to impair the permeability or free flow of water from one lamina to the other at their respective interfaces.

The cleansing or lubricating agent which may be incorporated in a pad or other substrate is a soap or synthetic detergent, or a combination thereof in a solid or semisolid form. The use of soap per se or a combination being preferred.

To amplify the function of polishing the metal surfaces, using substrates containing abrasives as previously described, in combination with a lubricating agent greatly increases polishing ability over the abrasive webs alone. It has been found that soaps, or soaps, in conjunction with detergents are superior lubricating agents than detergents alone.

It has also been found that waxes, and particular carnauba wax, are excellent lubricating agents alone or dispersed within soaps, or soap detergent mixtures when used in conjunction with the abrasive webs of this invention. It has been found that lubricants, suitably fatty acid lubricants, particularly stearic acid, when applied to the individual abrasive particles before applying these abrasive particles to the heretofore mentioned webs either alone or with soaps and soap detergent mixtures, yield superior results. Also, a natural wax when admixed with water, can be sprayed in a very thin film on the surface of the particles or the completed abrasive webs.

An article of the present invention may comprise a soap solid at ambient temperature. A large number of such soaps are available in commerce. Such soaps, as well as the foregoing waxes or lubricants, may be coated over all of the fibers by, say, immersion into a bath of liquid soap or, more suitably, injected in the liquid state into the interior of the article.

The soap may be disposed between a second or an inner web of foamed material and one of the outer webs of abrasive material. Alternatively, the cleansing agent is heated to a liquid state, injected into the inner web and permitted to solidify on cooling. It will be understood by those skilled in the art that where the flame sealing embodiment is employed, the cleansing material will tend to be melted into the inner web. Suitably, the amount of soap is between 25 and 75% by weight of the entire article.

The abrasive material is finely divided, water insoluble abrasive which complies with the aforementioned hardness criteria, having a size range of about 10 to about 300 microns. It may be a metal, a naturally occurring mineral or a glass. Suitable materials include copper alloy, iron, nickel alloy or steel, especially finely divided stainless steel. Spherical glass beads are also useful both per se and in conjunction with other abrasives. Suitably the abrasive material is coated at a density of between about 140 and about 250 g/m$^2$ of gross area. The term gross area means the area obtained by, say, multiplying the breadth times the width of a given rectangular surface. It does not mean the actual surface area provided by each individual fibre, which would be a very substantially larger amount.

The abrasive particles may be sprayed onto the outer webs in a particle binder through spray nozzles prior to the cutting step. Alternatively, and preferably, a binder is sprayed onto the needle punched web and the abrasive powder sprayed onto said coating. Optionally, an upper coating of binder is applied and the entire web is cured. Thereafter, if desired, the cleansing agent is added and the pads cut to desired size or the foamed synthetic thermoplastic layer is attached to a single web or laminated between two webs and the cleansing agent added. As binders there may be employed any suitable binders which set to a resin which is substantially insoluble in water and organic solvents after evaporation of the aerosol carrier therefore.

This technique of application is equally applicable when, in place of a web the substrate is a foam pad, a woven or non-woven fabric or a substantially water resistant paper.

It is therefore an object of this invention to improve upon a cleansing aid in the form of an abrasive pad and adaptable for home use in scouring kitchen utensils made of metals, such as moderately soft metals such as aluminum, bronze, brass or copper. Improvements in scouring utensils of stainless steel can also be used.

It is a further object of this invention to provide a cleansing aid in the form of a scouring pad having a self-contained supply of cleansing agent incorporated therewith.

It is also an object of this invention to provide an abrasive scouring pad with means for preventing unnecessary waste of the cleansing agent incorporated therewith.

It is a still further object of the invention to provide an improved method for fabricating a cleansing aid in the form of an abrasive scouring pad which may have incorporated therewith a self-contained cleansing agent.

Further objects of the invention, together with the features contributing thereto and the advantages accruing therefrom, will be apparent from the following description when read in conjunction with the drawings wherein:

DETAILED DESCRIPTION OF THE DRAWINGS

Figure 1:
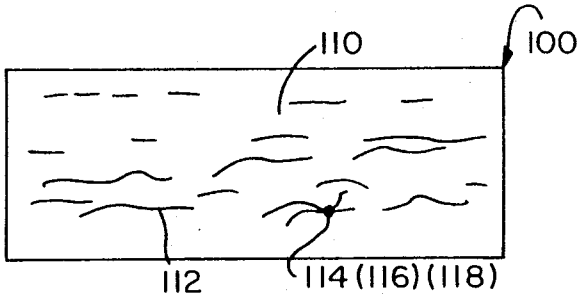
FIG. 1 is a side elevational sectional view of a scouring pad according to one embodiment of the instant invention.

Referring now in particular to FIG. 1, it will be seen that a pad 100 in accordance with the first embodiment of the invention comprises web material 110. The initially substantially non-abrasive web material 110 is comprised of a plurality of individual fibers 112 randomly oriented, non-woven, and loosely held together at the points where they contact one another by needle punching. The web material 110 presents an open, lofty and somewhat resilient structure possessing extremely low density and containing a network of many relatively larger intercommunicating voids.

Figure 2:
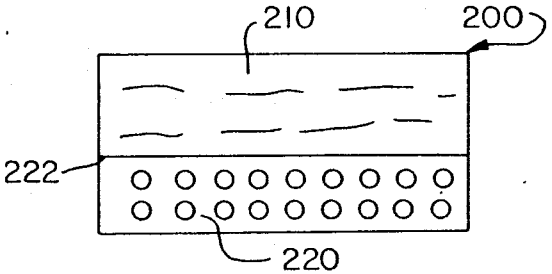
FIG. 2 is a side elevational sectional view of a scouring pad according to a second embodiment of the invention.

Referring now in particular to FIG. 2, it will be seen that a pad 200, in accordance with this embodiment of the invention comprises a laminate structure which includes upper lamina 210 of web material and a further lamina 220 of a synthetic sponge-like foamed plastic material, joined thereto at surface 222.

Figure 3:
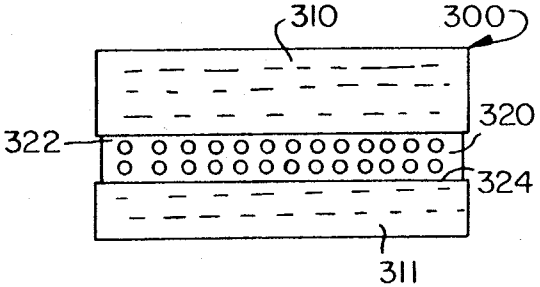
FIG. 3 is a side elevational sectional view of a third embodiment.

Referring now in particular to FIGS. 3, a pad 300 in accordance with these embodiments of the invention comprises a sandwich laminate structure which includes upper lamina 210 of web material, a further lamina 320 of a synthetic sponge-like foamed plastic material joined thereto at 322 and a further lower layer of web material 311, joined to said foam lamina 320 at 324.

Figure 4:
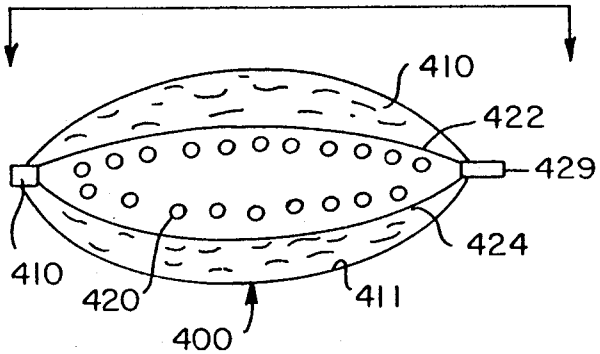
FIG. 4 is a side elevational sectional view of a scouring pad according to still another modification of the third embodiment of the invention.
Figure 5:
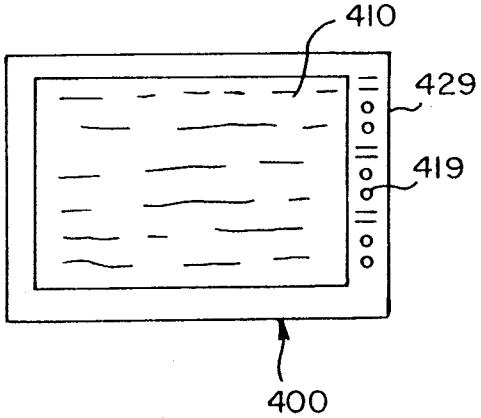
FIG. 5 is a plan of the pad shown in FIG. 4 at section 5—5.

Referring now in particular to FIGS. 4 through 5, a pad 400 in accordance with these embodiments of the invention comprises a laminate structure which includes upper lamina 410 of web material, a further lamina 420 of a synthetic sponge-like foamed plastic material and a further lower layer of web material 411, which is sealed at the edges to provide a scraping edge 419.

In the embodiments of FIGS. 1-5 which contain a cleansing agent 330, the cleansing agent may be disposed over the fibers of the outer web, suitably by dipping into said cleansing agent in the liquid phase.

Alternatively, in the embodiments of FIGS. 2-5, a discrete amount of cleansing agent may be disposed within the pad at the interfaces 222, 322, 324 or 424 between the foam lamina 220, 320 or 420 and the web lamina 210, 310 or 410 respectively. Alternatively within the foam laminae 220, 320 or 420 is a water soluble cleansing agent 330 which may be either a soap, synthetic detergent, or a combination of both. The cleansing agent is introduced to the pad during fabrication thereof as a pasty, semisolid deposit which may, however, before usage, depending upon the length of time between fabrication of the pad and usage, dry out and become solid so as to constitute a thin tablet or wafer. The cleansing agent could, however, if desired, be initially incorporated into the pad structure in a solid tablet or wafer form.

The foam lamina 220, 320 or 420 comprises a web of foamed plastic material such as polyurethane or the like. Such materials are flexible and compressible thereby providing added resilience to the overall pad structure. Such material is also, due to its cellular structure, higher absorbent, thereby enabling it to serve as a reservoir for retaining the cleansing agent in liquified form after application of water thereto. In use, pressure applied to the pad incident to the scrubbing action compresses the foam material of the inner lamina causing it to exude the retained solution of cleansing agent which thereupon flows freely through the open structure of the outer lamina of the pad to the pad outer surface to assist and complement the abrasive action of the pad in removing the dirt, grease or other foreign substances from the article being cleaned.

In the form of pad illustrated in FIGS. 4 and 5, the border areas of the three laminae 410, 420 and 411 are bound together under application of suitable heat and pressure at said border areas to form a heat seal bond firmly securing the respective laminae into a unified and integral pad structure. Application of a suitable degree of heat to the border area of the pad when under compression breaks down the cellular structure of the foamed thermoplastic material of the inner lamina 420 to render it more dense while fusing thereto the web material of the outer laminae 410, 411. At the same time, the fibers 110 of the outer laminae become bound together by the binder incorporated therewith under the influence of the heat to result in a fin-sealed lip or edge 429 as shown. The fin-sealed edge constitutes a relatively thin and rigid pad portion having, after coating, a good abrasive surface thereby being particularly effective and useful for reaching into small cracks, crevices or other small openings in the article or utensil to be cleaned, which type of openings could not be effectively cleaned in the absence of such a fin-sealed edge on the pad. Also, by binding the respective laminae together in this manner, it will be apparent that the interface between the major portions of the inner and outer laminae contain no impediment to the free flow or intercommunication of water or cleansing solution therebetween.

Figure 6:
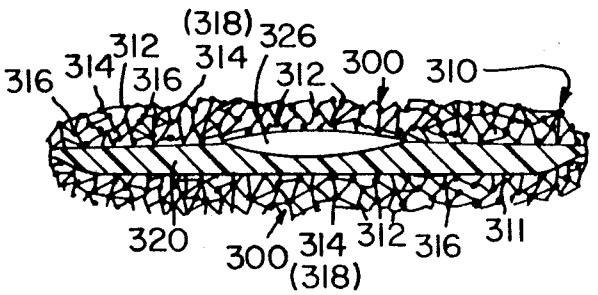
FIG. 6 is a side elevational sectional view of a scouring pad according to still another modification of the third embodiment of the invention showing the presence of a soap module.

The detailed structure of the devices of the present invention is readily illustrated by reference by FIG. 6. To the needle punched web 316 is added a binder, preferably resin, which coats each fiber along its length and particularly at the juncture points between the respective fibers is sprayed onto the web. Thereafter there is distributed along each fiber within the web material (but not exclusively present at said globules 314) are also fine particles of abrasive material 316 such as stainless steel powder, glass spheres and materials of similar hardness as defined above, the abrasive particles being adhered to the web structure by the said particle binder and preferably concentrated at or near the outer surface of the webs. If desired a further coat of binder 318 is applied over the abrasive 316. The soap module 326, in this modification, lies between web 310 and foam 320.

The thickness of the web material constituting respective laminae of the pad is not critical and may be varied without substantially impairing the usefulness of the pad as a cleansing pad. Typically, the laminae of web material may have a thickness of about 0.6 to 1.25 cm., with the thickness of the foamed plastic material constituting the foam laminae of the pad being about 0.3 to 0.6 cm. Pads comprised of laminae having the foregoing thickness dimensions have been found to be of an overall thickness which renders them highly effective as cleansing aids, and convenient to handle.

The fiber batt of 40 denier polyester can be formed using a variety of standard techniques known to one skilled in the art. A Rando-weber or a textile card equipped with a cross-lapper can be used to form the base web to the desired weight and thickness. Once formed, the web is ready for the application of bonding agents or alternately, the web can be fed into a needle punch machine to lightly tack the fibers together prior to applying bonding agents. The light punching of the fibers yields a web with significantly higher strength. The web can then be sprayed with resin to facilitate handling.

Alternatively, a web may be purchased commercially.

The resinated non-woven substrate roll is positioned on a delivery stand and fed to a base coat spray apron fitted with flat wire belt, and passed directly under an horizontal transverse reciprocator. The reciprocation is set at a predetermined rate and is fitted with a automatic recirculating airless gun and is also equipped with an on/off switch controlled by a programmable logic controller and inductive proximity limit switches to spray only a portion of the width substrate passing between the sprocket centers of the reciprocator. A wet coating is then supplied to it by an airless pump to provide the wet base coat required.

Immediately after the base coat spray apron, the wet substrate passes under a coating machine which has been modified to handle the dry abrasive powders. The abrasive powder is delivered onto the wet substrate across the width when it passes from the base coat to top coat spray apron.

A top coat spray apron similar to the base coat one carries the wet substrate with powder under a pneumatic cable cylinder horizontal transverse machine set at a predetermined rate is fitted with a conventional air atomizing automatic spray gun, equipped with an air nozzle and fluid nozzle. A pressure feed tank delivers the wet top coat to the gun. Fluid and atomizing air pressures are adjusted to deliver the top coat, if desired.

Immediately after the top coat spray apron, the wet substrate enters a gas fired and conveyorized oven to dry and cure the coating onto the substrate.

A take-up cart equipped with two wooden rolls moving in the same direction winds the coated substrate up into a roll when a cardboard core is positioned above the two rolls. After the first side is coated, the process is repeated for the opposite side.

Figure 7:
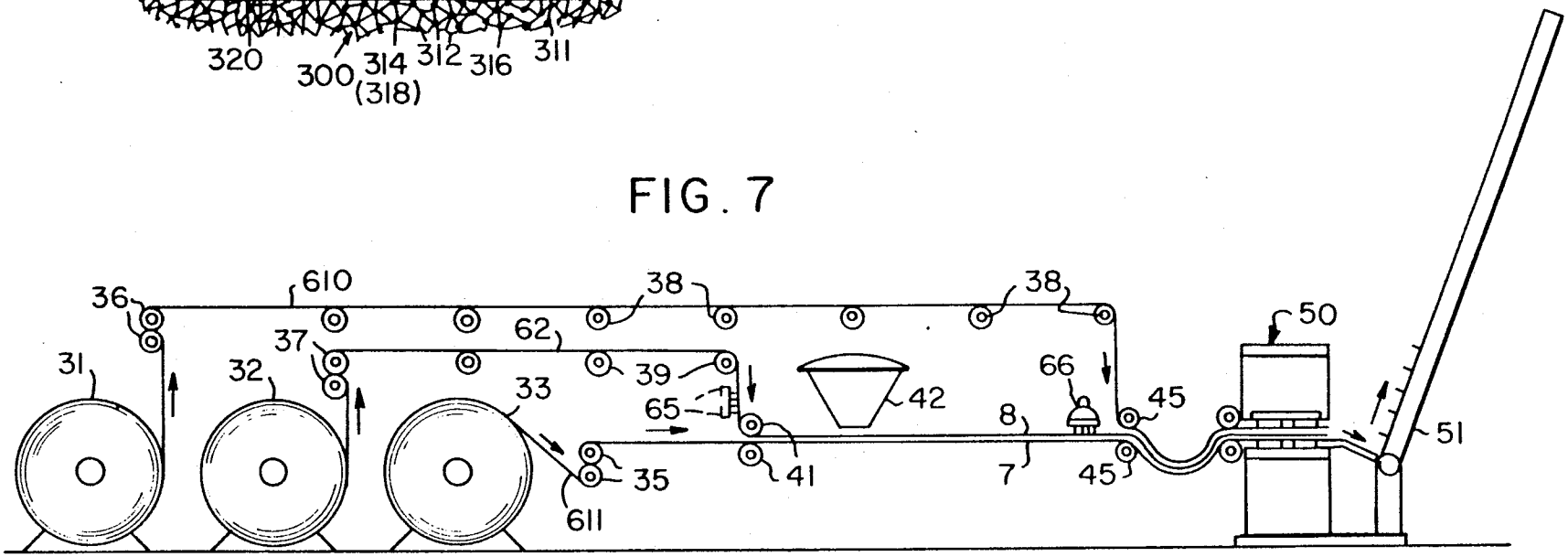
FIG. 7 is a diagrammatic view illustrating the process for fabricating scouring pads according to FIGS. 4 and 5 of the instant invention.

FIG. 7 depicts the process for fabricating the above described pad of FIGS. 4 and 5. As shown, elongate sheets of fibrous web material 610, 611 are supplied from spools 31, 33 thereof, a sheet of foamed thermoplastic material 620 being supplied from a spool 32 thereof. The sheets are continuously withdrawn from their respective spools at a uniform rate, the sheet of web material 611 being fed through a suitably driven pair of feed rolls 35 while the other sheet of web material 610 and the sheet of foamed thermoplastic web material 620 are similarly fed by suitably driven feed rolls 36, 37 respectively. The sheet 610 is thereafter supported by a series of rolls 38, the sheet 620 being thereafter supported by a series of rolls 39. As the sheet 611 is fed into the nip of feed rolls 41 it is brought into contact with the sheet 620, the two sheets thereafter being fed in superposed relation beneath a dispenser 42 which is charged with the cleansing agent and deposits measured amounts thereof intermittently at spaced increments both laterally and longitudinally relative to the upper surface of sheet 620. As the two sheets 611, 620 enter the nip of feed rolls 45, the upper surface of sheet 620 is brought into contact with sheet 6 which overlies the deposits of cleansing agent, the three sheets thereafter being fed in superposed relation to one another into a die-cutting press 50. Feed through the die-cutting press is intermittent in synchronism with the cyclic operation of the press, the momentary interruption of feed being compensated for by permitting the combined sheets to develop a loop between the feed rolls 45 and the press.

For fabricating the pads according to the FIG. 1 embodiment thereof, the sealing press 50 operating to compress and heat seal the three sheets 611, 611 and 620 in a plurality of oval patterns to form the fin-seal edge 18 of the individual pad structure, after the sealing step the abrasive is sprayed on by jets 71 or 72. In the second stage of the operation, a cutting press 58 operates to cut or sever the three sheets at the heat sealed area so as to separate the individual pads from the elongate sheet material, which pads are then directed to a suitable conveying mechanism 51 for delivery of the completed pads to another location. The heat sealing and cutting pattern effected by the press on the sheets of web material can be seen in FIG. 6 which shows a section of the sheet material remaining as scrap after individual pads have been separated therefrom. The individual pads are cut out from a pattern in which they are aligned in a series of transverse rows, the adjacent rows being relatively offset from one another in the interests of minimizing waste of the web material from which the pads are formed. It will of course be understood that the spacing of the areas cut away from the sheets to produce the individual pads is arranged to coincide with the placement of the cleansing agent deposited by the dispenser 42, so that each of the resulting pads will have incorporated therewith a deposit of said cleansing agent.

Figure 8:
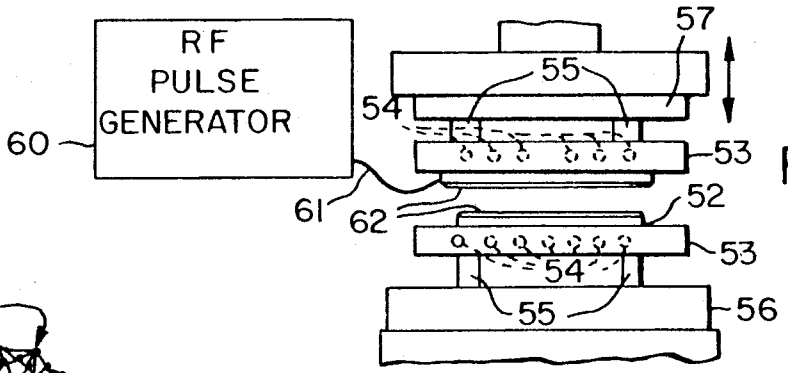
FIG. 8 is a more detailed view in enlarged scale of a part of the pad fabricating equipment illustrated in FIG. 7.

FIG. 8 illustrates in greater detail the portion of the press effective in the first stage of operation for heat sealing the sheet material to form the fin-seal edge of the individual pads. As shown, the mechanism includes opposed heating dies 52 mounted in heated blocks 53 each provided with a plurality of electrical resistance heat cartridges 54. The blocks 53 are supported on posts 55 of heat insulating material, the posts 55 associated with the lower die being mounted on a stationary portion 56 of the press, the posts associated with the upper die being secured to a reciprocally driven portion 57 of the press. Preferably, heating of the web material is also achieved dielectrically by radio frequency energy supplied from a radio frequency pulse generator 60, the output of the generator being transmitted to the upper die 52 through a flexible conductor 61 connected thereto. Shorting out of the radio frequency energy across the gap between the dies 52 is prevented by coating the edge of the dies with a hard dielectric substance 62 such as a ceramic or the like. The use of dielectric heating by radio frequency energy lessens the time to heat the web material to the desired temperature. It also avoids the tendency which would otherwise exist for the dies to stick to the web material.

For fabricating the pad according to the FIGS. 2 and 3 embodiment, a slightly modified process is employed. According to this modified process for the FIG. 2 embodiment, a gas burner manifold 65 provided with a series of gas jets is disposed so as to direct a flame on the undersurface of sheet 620 immediately prior to its being brought into contact with sheet 611 at the nip of the feed rolls 41. Accordingly, as the sheets 611 and 620 pass between the rolls 41 and the heated surface of sheet 620 starts to cool, the two sheets become flame laminated over their entire abutting surfaces.

For the FIG. 3 embodiment, a similar gas burner manifold 66 is disposed so as to direct a flame over the entire upper surface of sheet 620 immediately prior to its being brought into contact with sheet 610 by the feed rolls 45. Accordingly, as sheets pass between rolls 45, sheet 610 becomes surface bonded to the upper surface of sheet 620, the three sheets being thereby bonded one to another at their respective interfaces as they are fed into the press 50. In this modified process the press 52 performs only a single stage operation of severing individual pads from the elongate sheets. The heretofore described first stage of press operation, employed for producing pads of the FIG. 1 embodiment, not being employed in the modified process for producing pads in accordance with the FIG. 2 and 3 embodiment thereof.

Although there has been shown and described what are considered to be preferred embodiments of the invention, it is of course understood that obvious changes or variations could be made from the forms and techniques specifically described and disclosed herein without departing from the spirit of the invention. It is therefore intended that the invention be not limited to the precise forms and techniques herein shown and described nor to anything less than the whole of the invention as hereinafter claimed.

EXAMPLES cl Example 1

Fiber batt formation

The fiber batt of 40 denier polyester can be formed using a variety of standard techniques known to one skilled in the art. A Rando-weber, Model D, (manufactured by Rando Machine Co., Macedon, N.Y.,) or a textile card equipped with a cross-lapper can be used to form the base web to the desired weight and thickness. Once formed, the web is ready for the application of bonding agents or alternately, the web can be fed into a needle punch machine to lightly tack the fibers together prior to applying bonding agents. The light punching of the fibers yields a web with significantly higher strength. The web is then lightly sprayed with an acrylic resin to facilitate handling.

Alternately, a web may be purchased commercially with the following specifications.

Weight—2.5 mg./cm$^2$
Fiber—100% 40 Denier Polyester
Binder—Rohm & Haas TR 407
Fiber/Binder Ratio—80/20
Thickness—1.90 cm.

Among the suppliers of this material are E. R. Carpenter Co., Russelville, Ky.; Moldan Corp., York S.C., and Kemwove Inc., Charlotte, N.C.

Example 2

Scrub Puff Coating Procedure a) First Base Coat

The resinated non-woven substrate roll is positioned on a delivery stand and fed to a base coat spray apron fitted with a 2.5×2.5 cm mesh flat wire belt, moving at 1.93 cm./min. The substrate passes directly under an Horizontal Transverse Reciprocator Machine (DeVilbiss Type TYDB-508). The reciprocation is set at 15 strokes/min. and is fitted with a Automatic Recirculating Airless Gun (Binks Model 560) and is also equipped with an on/off switch controlled by a programmable logic controller and inductive proximity limit switches to spray only the 111.76 cm. width substrate passing between the 200 cm. sprocket centers of the reciprocator. (0.53 cm.) orifice size is used in the gun. A wet coating (see Table I) is then supplied to it by an Airless Pump, (Aro Model 650465-811), rated at 20:1 fluid pressure to air inlet pressure. Approximately 2–8 Kg/cm$^2$ psi inlet pressure delivers the 2.099–3.205 g/m$^2$ wet base coat required.

b) Abrasive Coating

Immediately after the base coat spray apron, the wet substrate passes under a Christy Machine Company "Coat-O-Matic", Model 60"-DI-S, with modified to handle the dry abrasive powders. These modifications include an extra fine diamond knurled 3.175/cm diameter rotary dispensing shaft, additional density plate studs to hopper body, internal head pressure relief plate, additional front brush, and an alternate slide adjuster having a 111.76/cm symmetrical dispensing width. The abrasive powder (see Table I) is delivered onto the wet substrate across the width when it passes from the base coat to top coat spray apron. A setting of approximately 21% setting on the motor drive fitted to the rotary shaft delivers the 560 g/min. abrasive powder required for the 2.234 g/m$^2$ dry coat.

c) Second On Top Coat

A top coat spray apron similar to the base coat one and moving at 4.194/cm/min. carries the wet substrate with powder under a Pneumatic Cable Cylinder Horizontal Transverse Machine (Reciprocator). This reciprocator is set at approximately 70 strokes/min. and is fitted with a Binks Model 610 conventional air atomizing automatic spray gun, equipped with a #63 PE Air Nozzle and #63 Fluid Nozzle. A Pressure Feed Tank (DeVilbiss Type QM 5095-3), delivers the wet top coat (see Table I) to the gun. Fluid and atomizing air pressures are adjusted to deliver 148.-.1765 mg/m$^2$ top coat.

Immediately after the top coat spray apron, the wet substrate enters a Sargent-Serial #2034—gas fixed and conveyorized 4.267 m long oven, set at 162° C. and 193.55 cm., to dry and cure the coating onto the substrate.

A take-up cart equipped with two wooden rolls moving in the same direction winds the coated substrate up into a roll when a cardboard core is positioned above the two rolls. After the first side is coated, the process is repeated for the opposite side.

Example 3

Soap and Soap/Detergent Loading

Under mild agitation, there is added enough Armour Dial #7344 crushed soap pellets to water at 82° C. to make a 30% solids solution. The soap solution is cooled to room temperature and injected into a device of Example 2 (wt. 4.4 g.) with a syringe. The soap is allowed to dry to yield a device of 11.5 gms. wt.

In accordance with the above procedure, to the solution is added 4.49 gms. ±7 an equal volume of Joy (trademark of Colgate-Polmolive) dishwashing detergent. Upon drying, a similar product is obtained.

Example 4

Detergent Loading

Full strength Joy (trademark of Colgate-Polmolive) dishwashing detergent is poured directly onto the device of Example 2. The detergent was allowed to dry to yield a device of 10 gms. wt.

Example 5

Carnauba Wax

54° C. water are premixed with 0.63 grams of Methocel F4M to make a high viscosity gel. The premix is cooled to room temperature and 23 grams of Duramul 0814—a 35% solid aqueous dispersion of Carnauba Wax (manufactured by Astor Wax Corp) is added. A portion (25 ml) of the formulation is injected into a device of Example 2 with a syringe to provide, on drying, a device of 15.3 gms wt.

Example 6

Woven And Non-woven Substrates a) A typical abrasive formulation of the present invention comprises:

| | Wet | Dry* |
|---|---|---|
| Water | 100 | — |
| Methocell KHMS | 3.5 | 3.5 |
| HA-12 acrylic emulsion | 60 | 27 |
| SCM 304 stainless steel coated with lithium stearate | 62.9 | 62.9 |

(*Net weight after drying)

b) Utilizing the procedures of Example 2a. The formulation of section (9) above is applied to woven or non-woven substrate.

i) Woven: Terrycloth (234 g/m$^2$) was coated with 175 g/m$^2$ per side (one or two) of the above abrasive formulation.

ii) Non-woven: A natural cellulosic wipe (110 g/m$^2$) was coated with 88 g/m$^2$ per side (one or two with the above formulation).

In accordance with the above procedure any of the above substrates listed herein can be similarly coated. Similarly, in place of SCM 304 any of the above abrasives listed in Table I which fall within the permitted parameters may be employed.

Comparison of Polishing Capability of Certain Abrasives

Controls A through Q

In accordance with the procedure of Example 2 the following abrasives were coated onto the substrates listed below:

A: Shelblast AD-10.5B, walnut shells; B: Novaculite 200 mesh sand; C: 180 mesh silicon carbide; D: 280 mesh silicon carbide; E: 280 mesh alumina; F: 200 mesh olivine sand. G: 100 mesh, stainless steel powder #304-LSC, SCM Corp., Cleveland, Ohio; H: ampal 611 atomized aluminum powder, United States Bronze Powders, Inc., Flemington, N.J. I: #2224 soda lime glass spheres, Potters Industries, Inc., Hasbrouck Heights, N.J.; J:[1] (ss) stainless steel flake #316, United States Bronze Powders, Inc., and [1] (gls) #3000 glass spheres, Potters Industries, Inc., * these abrasives were not sprayed on after the base coat but mixed in with the base coat and sprayed on with it; K: 434 unannealed stainless steel powder, SCM Corp.; L: iron alloy powder #4600, SCM Corp., Cleveland, Ohio; M: #2227 soda lime glass spheres, Potters Industries, Inc., Hasbrouck Heights, N.J.; N: stainless steel powder #316-L, SCM Corp., Cleveland, Ohio; O: annealed stainless steel powder #410-L, SCM Corp., Cleveland, Ohio; P: microcrystalline silicon dioxide, grade 200, Illinois Minerals Company, Cairo, Ill.; Q: stainless steel powder #304-L, SCM Corp., Cleveland, Ohio.

Substrates: PE/U 94.8 gm/m$^2$ needle punched polyester heat sealed to urethane foam; U: urethane foam.

Other components: Rhoplex HA12 is a water-based acrylic polymer, manufactured by Rohm and Haas Co., melamine formaldehyde resins, manufactured by Astro Industries, Inc., Morganton, N.J. Cymel 301 is a hexamethoxymethylamine cross-linking agent, manufactured by American Cyanamid Co., Wayne, N.J. Luconyl Blue 708, a blue pigment dispersion, manufactured by BASF Corporation, Parsippany, N.J. AL 190 WD is a water dispersible aluminum paste, manufactured by United States Bronze Powders, Inc., Flemington, N.J. MD200 is a non-leafing grade aluminum powder, manufactured by Alcan-Toyo America, Inc., Naperville, Ill. Silane A1106 is an aqueous solution of an aminoalkyl silicone, manufactured by Union Carbide Corp., Danbury, Conn. Swift 22005 is a one component moisture cure polyurethane adhesive, manufactured by Swift Adhesives, Downers Grove, Ill.

The resulting materials were tested for polishing/scratching qualities. The results are listed in Tables 1 (a), (b) and (c) below together with the appropriate base and top coat components and amounts. Sample 1 is urethane foam coated on both sides. Samples 2,3,6,8–12, 16 and 18 are sandwiches of web material with web on each side (FIG. 3), 1st and 2nd refer to the exposed sides of the web. Samples 4 and 5 are single laminates (FIG. 2), and samples 13, 14 and 15 are urethane foam coated on one side only.

While the substrates used were needle punched polyester and urethane foam and needle punched polyester is preferred, it is apparent that equal polishing results could be obtained by applying the abrasives in the hardness range indicated above to other substrates such as woven and non-woven cloths, polyethylene, or vinyl foams, various wet strength papers, sponges and the like.

TABLE 1 (a)

| | POLISHING/SCRATCH TEST RESULTS | | | | | |
|---|---|---|---|---|---|---|
| | 1 | 2 | 3 | 4 | 5 | 6 |
| Abrasive | A | B | C | D | E | F |
| Substrate | U | PE/U | PE/U | PE/U | PE/U | PE/U |
| Rhoplex HA 12 | 250 | 250 | 250 | 300 | 250 | 250 |
| AstroMel NW6A | 100 | | | | | 100 |
| AstroMel NW8A | | | 100 | 120 | | |
| Cymel 303/*307 | | 100 | | | 100* | |
| Water | | | | 300 | 60.0 | |
| 20% aq $NH_4Cl$ | | | 20 | | | |
| BASFlucBlu 708 | | | | 1 | | |
| AL190WD | 10 60 | 60 | 45 | | | 45 |
| MD200 | | | | | 30.6 | |
| Silane A1106 | | | 3 | 3 | | |
| Swift 22005 | 50 | | | | | |
| Sides | bottom top | 1st 2nd | 1st 2nd | | | 1st 2nd |
| Surface area cm$^2$ | 103 103 | 161 161 | 8361 8361 | 161 | 161 | 161 161 |
| Wet base wt, g. | 7.31 | 3.0 3.48 | 120 194 | 2.4 | 2.2 | 1.81 1.73 |
| Abrasive wt. g. | 0.5 | 2.4 2.8 | 27.6 41.5 | 1.01 | 1.3 | 1.31 1.01 |
| Top Coat Wt. g. | 0.45 | 0.28 0.33 | 20.0 25.9 | 0.5 | 0.35 | 1.1 0.4 |
| Knoop Hardns. | | | 2500 | 2500 | 2050 | |
| Mho's Hardns. | 3–4 | 7 | | | | 6–7 |
| RockwellB Hrd. | | | | | | |
| Result | non-abrasive | agrssve scrtch | severe scrtch | too agrssve | too agrssve | too agrssve |

Abrasives: A:Shelblast AD-10.5B, walnut shells; B:Novaculite 200 mesh sand; C: 180 mesh silicon carbide; D:280 mesh silicon carbide; E: 280 mesh alumina; F: 200 mesh olivine sand.
Substrates: PE/U 94.8 gm/m$^2$ needle punched polyester heat sealed to urethane foam. U: urethane foam.

Philadelphia, Pa. Astromel 6A and 8A are methylated

TABLE 1 (b)

| | 7 | 8 | 9 | 10 | 11 |
|---|---|---|---|---|---|
| Abrasive | G | H | I | J | K |
| Substrate | PE/U | PE/U | PE/U | PE/U | PE/U |
| Rhoplex HA 12 | 250 | 250 | 250 | 250 | 250 |
| AstroMel NW6A | 100 | 100 | 100 | 100 | 100 |
| AstroMel NW8A | | | | | |
| Cymel 303 | | | | | |

TABLE 1 (b)-continued

| | 7 | 8 | 9 | 10 | 11 |
|---|---|---|---|---|---|
| Water | 40 | 40 | 40 | 100 | |
| 20% aq $NH_4Cl$ | | | | | |
| BASFluc Blu 708 | | | | | |
| AL190WD/900L* | 45 | 45 | 45 | 25* | 45 |
| MD2000 | | | | | |
| St Steel Flk316L | | | | 72 | |
| Glass Sph#3000 | | | | 100 | |
| Sides | 1st 2nd | 1st 2nd | 1st 2nd | 1st 2nd | 1st 2nd |
| Surface area $cm^2$ | 161 161 | 161 161 | 161 161 | 161 161 | 161 161 |
| Wet base wt. g. | 3.34 2.48 | 3.21 2.78 | 3.31 2.85 | 3.78 4.21 | 2.38 2.14 |
| Abrasive wt. g. | 1.25 1.30 | 2.65 2.65 | 2.91 2.91 | | 1.23 1.07 |
| Top Coat Wt. g. | 0.2 0.77 | 0.63 0.81 | 0.66 0.87 | | 0.17 0.17 |
| Knoop Hardns. | | | | | |
| Mho's Hardns. | | 2.0–2.9 | 6 | $6.0^{gls}$ | |
| Rockwell B Hrd. | 66 | | | $60^{ss}$ | |
| Result | like Brillo | No effect | good polish | v. gd polish | more scratch than G |

Abrasives: G: 100 mesh, stainless steel powder #304-LSC, SCM Corp. Cleveland OH; H: Ampal 611 atomized aluminum powder, US Bronze Co., Flemington NJ; I: #2224 soda lime glass spheres, Potters Industries, Hasbrouck Heights, NJ; J: [1](ss) stainless steel flake #316, US Bronze Co. and [2](gls) #3000 glass spheres, Potters Ind. *these abrasives were not sprayed on after the base coat but mixed in with the base coat and sprayed on with it; K: 434 unannealed stainle ss steel powder, SCM Corp.;

TABLE 1 (c)

| | 12 | 13 | 14 | 15 | 16 | 17 |
|---|---|---|---|---|---|---|
| Abrasive | L | M | N | O | P | Q |
| Substrate | PE/U | U | U | U | U | PE/U |
| Rhoplex HA 12 | 250 | | | | | 250 |
| AstroMel NW6A | 100 | | | | | 100 |
| AstroMel NW8A | | | | | | |
| Cymel 303 | | | | | | |
| Water | | | | | | |
| 20% ag $NH_4Cl$ | | | | | | |
| BASFluc Blu 208 | | | | | | |
| AL190WD | 45 | | | | 10 | 45 |
| MD2000 | | | | | | |
| Silane A1106 | | | | | | |
| Swift 22005 | | 50 | 50 | 50 | 50 | |
| Sides | 1st 2nd | | | | | 1st 2nd |
| Surface area $cm^2$ | 161 161 | 103 | 103 | 103 | 103 | 161 161 |
| Wet base wt. g. | 0.93 1.10 | 7.88 | 8.43 | 7.34 | 8.51 | 0.98 0.99 |
| Abrasive wt. g. | 1.18 1.17 | 4.35 | 4.41 | 4.31 | 0.57 | 1.18 1.12 |
| Top Coat Wt. g. | 0.12 0.12 | | | | | 0.062 0.062 |
| Knoop Hardns. | | | | | | |
| Mho's Hardns. | | 6.0 | | | 6.5 | |
| Rockwell B Hrd. | 80 | | 60 | 96 | | 66 |
| Result | better than G | good polish | almost as gd as $304^{ss}$ | not gd as 304 | excess scrtch | good polish |

Abrasives: L: iron alloy powder #4600, SCM Corp. Cleveland OH; M: #2227 soda lime glass spheres, Potters Industries, Hasbrouck Heights, NJ; N: stainless steel powder #316-L, SCM Corp. Cleveland OH; O: annealed stainless steel powder #410-L, SCM Corp. Cleveland OH; P: microcrystalline silicon dioxide, grade 200, Illinois Mineral Inc., Cairo, IL; Q: stainless steel powder #304-L, SCM Corp. Cleveland OH;

Comparison to Klecker U.S. Pat. No. 4,078,340

Controls R–T

Following the guidelines of U.S. Pat. No. 4,078,340, souring pads using Navajo FFFF pumice, Gemstar's Camel Carb (calcium carbonate) and Illinois Mineral's Imsil A-25, microcrystalline silice were prepared and evaluated to determine their polishing properties on aluminum panels.

R-Pumice as an Abrasive

| Component | Weight (g) |
|---|---|
| Water | 242.0 |
| Foammaster AP | 0.5 |
| Methocel F4M | 6.0 |
| Rhoplex HA-121 | 25.0 |
| Astro Mel NW-6A | 62.5 |
| Luc Green 936 | 1.0 |
| Navajo FFFF Pumice | 64.6 |

-continued

| Component | Weight (g) |
|---|---|
| | 501.6 |

S-Calcium Carbonate an Abrasive

| Component | Weight (g) |
|---|---|
| Water | 242.0 |
| Methocel F4M | 6.0 |
| Rhoplex HA-12 | 125.0 |
| Astro Mel NW-6A | 62.5 |
| Luc Green 936 | 2.0 |
| Camel Carb ($CaCO_3$) | 64.6 |
| | 502.1 |

Applied 16.6 grams to a 4"×4" piece of 8.6 oz/yd$^2$ needle punched polyester. The coating was dried in a 300° F. oven for one hour.

T-Silica as an Abrasive

| Component | Weight (g) |
|---|---|
| Water | 242.0 |
| Methocel F4M | 6.0 |
| Rhoplex HA-12 | 125.0 |
| Astro Mel NW-64 | 62.5 |
| Luc Green 936 | 2.0 |
| Imsil A-25 | 64.6 |
| | 502.1 |

Applied 15.3 grams to a 4"×4" piece of 8.6 oz./yd.$^2$ needle punched polyester. The coating was dried in a 300° F. for one hour.

A polishing test was performed on Ryerson #3003 aluminum panels. A panel was scoured using a 2% solution of Joy with a moderate amount of hand pressure. These abrasives did not provide good polishing properties in comparison to stainless steel and steel wool. However, the scouring pad containing Pumice was rated fair compared to calcium carbonate, which were rated as ineffective and silica which was unacceptable due to scratching.

Haze Reflection Measurement.

In order to determine the relative efficacy of certain lubricants, in particular soaps and detergents. Devices of Example 2 coated 304-LSC, S.S. Powder, (lithium stearate stainless steel powder) 100 Mesh, and Steel Wood (Grade #1 Medium Course) were utilized to polish Ryerson #3003 aluminum panels under an approximately 2% aqueous solution or suspension of these lubricants. The resulting panels were examined by a Spectrogard Color System spectrophotometer (manufactured by Gardner Laboratories, Silver Spring, Md.). The significant reading is the Y reading. Values of Y>30 are not acceptable.

The results for controls LA-LR are summarized in Table 3 below.

TABLE 3

MEASUREMENT OF HAZE REFLECTION (MACHINE CONDITIONS: 1964 cie 10°, CIE ILLUMINANT, D65 (DAYLIGHT) SPECULAR COMPONENT EXCLUDED.)

| PANEL ID | SCOURING PAD | FORMULATION | TRISTIMULUS VALUES CIE X, Y, Z | *POLISHING PROP. 1 = BEST, 20 = WORST |
|---|---|---|---|---|
| LL | STEEL WOOL | 1.98% SOS Soap | 17.40, 18.17, 20.13 | 1 |
| LN | STEEL WOOL | 1.99% aqueous solution of Armour Dial #7344 with Zonyl FST (0.2% Zonyl FST based on total solids) | 18.45, 19.58, 22.14 | 2 |
| LK | STEEL WOOL | 1.98% aqueous solution of Armour Dial #7344 | 19.64, 20.84, 23.56 | 3 |
| LM | STEEL WOOL | 1.98% aqueous solution of Joy | 20.48, 21.76, 24.68 | 4 |
| LT | STEEL WOOL | 2.0% aq. soln of Ajax (Colgate-Palmolive dishwashing detergent) | 21.65, 23.00, 26.13 | 5 |
| LA | SCRUB PUFF | 1.98% aqueous solution of Armour Dial #7344 | 23.01, 24.37, 27.86 | 6 |
| LB | SCRUB PUFF | 1.98% aqueous solution of SOS soap | 24.56, 25.99, 28.80 | 7 |
| LQ | STEEL WOOL | 20% aqueous solution of Bio Soft D-62 (LHS) | 28.03, 29.72, 32.86 | 8 |
| LD | SCRUB PUFF | 99% aqueous solution of Armour Dial #7344 with Zonyl FST, 0.2% Zonyl FST based on total solids | 28.37, 30.00, 32.94 | 9 |
| LR | STEEL WOOL | 2.0% aqueous solution of sodium Lauryl sulfates | 29.15, 30.94, 34.79 | 10 |
| LC | SCRUB PUFF | 1.93% aqueous solution of Joy (P & G) | 36.38, 38.51, 42.26 | 11 |
| LG | SCRUB PUFF | 2.0% aqueous solution of Bio Soft D-62 (LAS) | 40.20, 42.50, 45.97 | 12 |
| LJ | SCRUB PUFF | 2.0% aqueous solution of Ajax (Colgate Palmolive) | 41.44, 43.81, 47.52 | 13 |
| LH | SCRUB PUFF | 2.0% aqueous solution of sodium Lauryl sulfate | 44.34, 46.18, 49.56 | 14 |
| LI | SCRUB PUFF | 2.0% aqueous solution of lauramine oxide | 46.92, 47.47, 52.34 | 15 |
| LO | STEEL WOOL | Water | 47.21, 49.89, 53.58 | 16 |
| LF | SCRUB PUFF | 2.0% aq solution of Triton X-100 | 48.33, 50.98, 54.01 | 17 |
| LE | SCRUB PUFF | Water | 52.22, 52.94, 52.63 | 18 |
| LS | STEEL WOOL | 2.0% aqueous solution of lauramine oxide | 52.36, 55.26, 58.94 | 19 |
| LP | STEEL WOOL | 2.0% aqueous solution of Triton X-100 | 52.40, 55.30, 58.68 | 20 |

*Lowest Y value indicates the least amount of surface haze. (maximum polish). Steel wool means steel wool pad of grade #1, medium course. Scrub Puff means a device substantially as produced by Example 2.

I claim:

1. An open low density abrasive article adapted for the cleaning of moderately soft metallic surfaces comprising: a substrate selected from the group consisting of i) a lofty open non-woven three dimensional web form substrate of a plurality of interlaced randomly extending flexible durable, tough, resilient organic fibers having a diameter of from about 25 to about 250 microns, said web fibers being firmly adhesively bonded together at points where they cross and contact each other to form a three-dimensionally integrated structure throughout said web, there being defined throughout said article a tridimensionally extending network of intercommunicating voids constituting the major portion of the volume of the said article, said article being flexible and readily compressible and, upon release of pressure capable of recovering substantially completely to its initial form, the interstices between adjacent fibers being open and substantially unfilled by binder or abrasive, ii) a polymeric flexible foam selected from the group consisting of urethane, polypropylene, polyethylene, polyvinyl alcohol, silicone rubber, neoprene and natural rubber latex of density between about 0.015 g/cm$^3$ and about 0.1 g/cm$^3$, iii) woven fabrics of natural and synthetic fibers selected from the group consisting of terry, duck, twill, oznaberg, and leno of surface density between about 100 g/m$^2$ and about 410 g/m$^2$, iv) non-woven fabrics of natural and synthetic fibers selected from the group consisting of spunbonded, fibre entangled, thermal and chemical bonded and needle punched of surface density between about 75 g/m$^2$ and about 285 g/m$^2$ and v) high wet strength, substantially water resistant papers of the kraft or zinc chloride treated type of surface density from about 100 g/m$^2$ to about 1 kg/m$^2$, and abrasive particles distributed upon and within said substrate and firmly bonded to the substrate fibers by a relatively hard binder, wherein said abrasive is defined by any one of the measures of hardness selected from the group of measures consisting of:

| | | |
|---|---|---|
| a) | Mho's | 4.5-6.3 |
| b) | Rockwell B | 60-85 |
| c) | Brinell | 95-142 |
| d) | Knoop | 120-180 |

wherein the abrasive material is selected from the group consisting of finely divided copper base alloy, iron, nickel base alloy, spherical glass beads, steel or mineral.

2. An article of claim 1 wherein the substrate is a lofty open non-woven three dimensional web form substrate of a plurality of interlaced randomly extending flexible durable, tough, resilient organic fibers having a diameter of from about 25 to about 250 microns, said web fibers being firmly adhesively bonded together at points where they cross and contact each other to form a three-dimensionally integrated structure throughout said web, there being defined throughout said article a tridimensionally extending network of intercommunicating voids constituting the major portion of the volume of the said article, said article being flexible and readily compressible and, upon release of pressure capable of recovering substantially completely to its initial form, the interstices between adjacent fibers being open and substantially unfilled by binder or abrasive and the abrasive particles are distributed upon and within said web and firmly bonded to the web fibers.

3. An article of claim 1 wherein the substrate is a polymeric flexible foam.

4. An article of claim 1 wherein the substrate is a woven fabric of natural and synthetic fibers selected from the group of fibers consisting of cotton, polyester or nylon.

5. An article of claim 1 wherein the substrate is a non-woven fabric of natural and synthetic fibers selected from the group of fibers consisting of rayon, polyester or nylon.

6. An article of claim 1 wherein the substrate is paper.

7. An article of claim 1 wherein the metallic surface is aluminum, copper, brass or bronze.

8. An article of claim 1 wherein the abrasive material is finely divided stainless steel.

9. An article of claim 1 wherein the abrasive material is a finely divided mineral.

10. An article of claim 1 wherein the abrasive material is spherical glass beads.

11. An article of claim 1 wherein the abrasive material comprises spherical glass beads and stainless steel.

12. An article of claim 1 wherein the abrasive material is finely divided and does not exceed 300 microns in diameter.

13. An article of claim 2 wherein the substrate comprising a coating of said abrasive material on said web substrate of a density of between about 140 and about 250 g/m$^2$ of gross area.

14. An article of claim 1 additionally comprising a lubricant.

15. An article of claim 14 wherein the abrasive particles are coated with the lubricant.

16. An article of claim 14 wherein the lubricant comprises a soap, solid at ambient temperature.

17. An article of claim 14 wherein the lubricant comprises a wax, solid at ambient temperature.

18. An article of claim 14 wherein the lubricant comprises carnauba wax.

19. An article of claim 14 wherein the lubricant comprises a fatty acid.

20. An article of claim 16 wherein the amount of soap is between 25 and 75% by weight of the entire article.

21. An article of claim 17 wherein the amount of wax is between 5 and 40% by weight of the entire article.

22. An article of claim 2 in layer form, having an upper and a lower surface, additionally comprising a layer of natural or synthetic sponge-like material attached to one of said surfaces.

23. An article of claim 22 comprising a sponge-like layer between two layers of abrasive coated web.

24. An article of claim 22 comprising a sponge-like layer encapsulated within layers of abrasive coated web.

25. An article of claim 22 additionally comprising a soap, solid at ambient temperature.

26. An article of claim 3 in layer form, having an upper and a lower surface, additionally comprising a layer of natural or synthetic sponge-like material attached to one of said surfaces.

27. An article of claim 26 comprising a sponge-like layer between two layers of abrasive coated web.

28. An article of claim 26 comprising a sponge-like layer encapsulated within layers of abrasive coated web.

29. An article of claim 26 additionally comprising a soap, solid at ambient temperature.

30. An article of claim 4 in layer form, having an upper and a lower surface, additionally comprising a layer of natural or synthetic sponge-like material attached to one of said surfaces.

31. An article of claim 30 comprising a sponge-like layer between two layers of abrasive coated web.

32. An article of claim 30 comprising a sponge-like layer encapsulated within layers of abrasive coated web.

33. An article of claim 30 additionally comprising a soap, solid at ambient temperature.

34. An article of claim 4 in layer form, having an upper and a lower surface, additionally comprising a layer of natural or synthetic sponge-like material attached to one of said surfaces.

35. An article of claim 34 comprising a sponge-like layer between two layers of abrasive coated web.

36. An article of claim 34 comprising a sponge-like layer encapsulated within layers of abrasive coated web.

37. An article of claim 34 additionally comprising a soap, solid at ambient temperature.

38. An article of claim 5 in layer form, having an upper and a lower surface, additionally comprising a layer of natural or synthetic sponge-like material attached to one of said surfaces.

39. An article of claim 38 comprising a sponge-like layer between two layers of abrasive coated web.

40. An article of claim 38 comprising a sponge-like layer encapsulated within layers of abrasive coated web.

41. An article of claim 38 additionally comprising a soap, solid at ambient temperature.

42. An open low density abrasive article adapted for the cleaning of moderately soft metallic surfaces comprising: a substrate selected from the group consisting of i) a lofty open non-woven three dimensional web form substrate of a plurality of interlaced randomly extending flexible durable, tough, resilient organic fibers having a diameter of from about 25 to about 250 microns, said web fibers being firmly adhesively bonded together at points where they cross and contact each other to form a three-dimensionally integrated structure throughout said web, there being defined throughout said article a tridimensionally extending network of intercommunicating voids constituting the major portion of the volume of the said article, said article being flexible and readily compressible and, upon release of pressure capable of recovering substantially completely to its initial form, the interstices between adjacent fibers being open and substantially unfilled by binder or abrasive, ii) a polymeric flexible foam selected from the group consisting of urethane, polypropylene, polyethylene, polyvinyl alcohol, silicone rubber, neoprene and natural rubber latex of density between about 0.015 g/cm$^3$ and about 0.1 g/cm$^3$, iii) woven fabrics of natural and synthetic fibers selected from the group consisting of terry, duck, twill, oznaberg, and leno of surface density between about 100 g/m$^2$ and about 410 g/m$^2$, iv) non-woven fabrics of natural and synthetic fibers selected from the group consisting of spunbonded, fibre entangled, thermal and chemical bonded and needle punched of surface density between about 75 g/m$^2$ and about 285 g/m$^2$ and v) high wet strength, substantially water resistant papers of the kraft or zinc chloride treated type of surface density from about 100 g/m$^2$ to about 1 kg/m$^2$, and abrasive particles selected from the group consisting of finely divided copper base alloy, iron, nickel base alloy, spherical glass beads, steel or mineral distributed upon and within said substrate and firmly bonded to the substrate fibers by a relatively hard binder, wherein said abrasive is defined by any one of the measures of hardness selected from the group of measures consisting of:

| | |
|---|---|
| a) Mho's | 4.5–6.3 |
| b) Rockwell B | 60–85 |
| c) Brinell | 95–142 |
| d) Knoop | 120–180 |

wherein the coating of said abrasive material on said web substrate has a density of between about 140 and about 250 g/m$^2$ of gross area.

43. An open low density abrasive article adapted for the cleaning of moderately soft metallic surfaces comprising: a substrate selected from the group consisting of i) a lofty open non-woven three dimensional web form substrate of a plurality of interlaced randomly extending flexible durable, tough, resilient organic fibers having a diameter of from about 25 to about 250 microns, said web fibers being firmly adhesively bonded together at points where they cross and contact each other to form a three-dimensionally integrated structure throughout said web, there being defined throughout said article a tridimensionally extending network of intercommunicating voids constituting the major portion of the volume of the said article, said article being flexible and readily compressible and, upon release of pressure capable of recovering substantially completely to its initial form, the interstices between adjacent fibers being open and substantially unfilled by binder or abrasive, ii) a polymeric flexible foam selected from the group consisting of urethane, polypropylene, polyethylene, polyvinyl alcohol, silicone rubber, neoprene and natural rubber latex of density between about 0.015 g/cm$^3$ and about 0.1 g/cm$^3$, iii) woven fabrics of natural and synthetic fibers selected from the group consisting of terry, duck, twill, oznaberg, and leno of surface density between about 100 g/m$^2$ and about 410 g/m$^2$, iv) non-woven fabrics of natural and synthetic fibers selected from the group consisting of spunbonded, fibre entangled, thermal and chemical bonded and needle punched of surface density between about 75 g/m$^2$ and about 285 g/m$^2$ and v) high wet strength, substantially water resistant papers of the kraft or zinc chloride treated type of surface density from about 100 g/m$^2$ to about 1 kg/m$^2$, and abrasive particles selected from the group consisting of finely divided copper base alloy, iron, nickel base alloy, spherical glass beads, steel or mineral distributed upon and within said substrate firmly bonded to the substrate fibers by a relatively hard binder, wherein said abrasive is defined by any one of the measures of hardness selected from the group of measures consisting of:

| | |
|---|---|
| a) Mho's | 4.5–6.3 |
| b) Rockwell B | 60–85 |
| c) Brinell | 95–142 |
| d) Knoop | 120–180 |

and a fatty acid or wax solid at room temperature.

* * * * *

UNITED STATES PATENT AND TRADEMARK OFFICE

CERTIFICATE OF CORRECTION

PATENT NO. : 5,152,809

DATED : October 6, 1992

INVENTOR(S) : Henry Mattesky

It is certified that error appears in the above-identified patent and that said Letters Patent is hereby corrected as shown below:

Claim 1, column 19, line 20, delete "steel or mineral", insert --or steel--.

Claim 9, column 19, line 59, delete "mineral", insert --iron--.

Claim 42, line 46, delete "steel or mineral", insert --or steel--.

Claim 43, column 22, line 44, delete "steel or mineral", insert --or steel--.

Signed and Sealed this

Twenty-third Day of November, 1993

*Attest:*

Bruce Lehman

BRUCE LEHMAN

*Attesting Officer*

*Commissioner of Patents and Trademarks*